US007035563B2

(12) United States Patent
Sawada

(10) Patent No.: US 7,035,563 B2
(45) Date of Patent: Apr. 25, 2006

(54) IMAGE FORMING DEVICE

(75) Inventor: Erika Sawada, Mitsukaido (JP)

(73) Assignee: Canon Finetec Inc., Ibaraki (JP)

( * ) Notice: Subject to any disclaimer, the term of this patent is extended or adjusted under 35 U.S.C. 154(b) by 0 days.

(21) Appl. No.: 10/719,015

(22) Filed: Nov. 24, 2003

(65) Prior Publication Data

US 2004/0258424 A1 Dec. 23, 2004

(30) Foreign Application Priority Data

Nov. 27, 2002 (JP) ..... 2002-343620

(51) Int. Cl.
*G03G 15/16* (2006.01)

(52) U.S. Cl. ..... 399/66; 399/101

(58) Field of Classification Search ..... 399/38, 399/44, 66, 71, 94, 97, 101, 313, 314
See application file for complete search history.

(56) References Cited

U.S. PATENT DOCUMENTS 6,542,703 B1 * 4/2003 Jung ..... 399/44
6,823,152 B1 * 11/2004 Kida ..... 399/101

* cited by examiner

*Primary Examiner*—Hoang Ngo
(74) *Attorney, Agent, or Firm*—Harness, Dickey & Pierce, P.L.C.

(57) ABSTRACT

In the case that the electrical resistance of the contact transfer body 15 varies with the variation of the operating environment, the variation of the value of the electrical resistance is detected by the transfer body resistance detecting section and the applying time of the transfer cleaning bias is appropriately varied by the cleaning bias control section 23 based on the detected result. When the operating environment varies to a high temperature condition or to a high humidity condition, the applying time of the transfer cleaning bias is shortened by the cleaning bias control section 23, and the continuation of the conventional over-discharged condition is avoided. Therefore, even when the value of the electrical resistance of the contact transfer body 15 varies according to the variation of the operating environment, the image can be formed with a high degree of quality and the shortening of the service life of the image carrier can be prevented.

11 Claims, 4 Drawing Sheets

IMAGE FORMING DEVICE

FIELD OF THE INVENTION

The present invention relates to an image forming device in which cleaning operation of a contact transfer body is performed by applying a transfer cleaning bias whose polarity is inverted from that of a transfer bias on the contact transfer body disposed to contact with an image carrier.

DESCRIPTION OF RELATED ART

In various types of image forming devices such as an electro-photographic copier or a printer, for example, as shown in FIG. 5, after the surface of a photosensitive drum 1 as an image carrier is uniformly electrified by a primary electrifying bias which is applied by an electrifying roller 2, an electrostatic latent image is formed by an information modulated radiation 4 emitted in a spot shape while being subjected to main scanning by an optical writing unit 3. The electrostatic latent image on the photosensitive drum 1 is developed with toner supplied from a developing unit 5 and the toner image is formed on the photosensitive drum 1. A transfer roller 6 as the contact transfer body is arranged so as to form a nip part in the transfer portion of the photosensitive drum 1. An appropriate transfer bias is applied to the transfer roller 6 as the contact transfer body and thereby the toner image on the photosensitive drum 1 is electrostatically transferred on a recording paper P which is fed from a paper supply unit 7.

When the transfer roller 6 which is arranged to contact with the photosensitive drum 1 as described above, a fogging toner which is generated on the photosensitive drum 1 and a toner on the photosensitive drum 1 which is not transferred on the recording paper P due to jamming tend to directly attach and remain on the surface of the above-mentioned transfer roller 6. The soiling of the surface of the transfer roller 6 may cause unstable transfer operations due to the variation of discharge quantity or may cause to soil the rear face of the recording paper P at the time of the next transfer operation. In order to prevent the soiling of the surface of the transfer roller 6, cleaning operation is regularly performed at the rotating time before and after an image forming step or the like. That is, a transfer cleaning bias whose polarity is inverted from that of the transfer bias is applied to the transfer roller 6 over an appropriate time period, and thereby the toner which is attached or remained on the transfer roller 6 is returned to the photosensitive drum 1.

However, the above-mentioned transfer roller 6 and the primary electrifying roller 2 are easily affected by the variation of temperature or humidity in the operating environment. Particularly, in an ion conductive type roller which has been used in recent years, that is, in a roller having a constitution that an elastic rubber layer having ion conductivity is provided on the outer peripheral side of a conductive core bar, its electrical resistance varies easily depending on ambient humidity in the operating environment. For example, in the environment of high temperature or high humidity, the electrical resistance value of the respective rollers is lowered, which tends to increase the discharge current to cause an overdischarged state. When the overdischarged state continues, the film shaving or the like in the surface of the photosensitive drum progresses. Therefore, the service life of the photosensitive drum is shortened and the lowering of sensitivity or memory occurs, and the image quality may be easily lowered.

SUMMARY OF THE INVENTION

In view of the problems described above, it is an advantage of the present invention to provide an image forming device which is capable of forming an image with a high degree of quality even when the electrical resistance of a transfer roller or a primary electrifying roller varies according to the variation of operating environment and is also capable of preventing from shortening the service life of an image carrier such as a photosensitive drum.

In order to achieve the above advantage, according to the present invention, there is provided an image forming device including an image carrier which holds a toner image formed by developing, a contact transfer body which is arranged so as to contact with a transfer area of the image carrier, a transfer bias application means which applies a transfer bias to the contact transfer body for transferring the toner image on the image carrier to a recording paper, and a transfer body cleaning means which applies a transfer cleaning bias whose polarity is inverted from that of the transfer bias to the contact transfer body over an appropriate time period for performing a cleaning operation for a toner which is attached or remained on the contact transfer body. The transfer body cleaning means further includes a transfer body resistance detecting section which detects and outputs an electrical resistance of the contact transfer body and a cleaning bias control section which changes an applying time of the transfer cleaning bias based on a detection output signal from the transfer body resistance detecting section.

According to the image forming device having such a constitution, in the case that the electrical resistance of the contact transfer body varies with the variation of operating environment, the variation of the electrical resistance is detected by the transfer body resistance detecting section, and the applying time of the transfer cleaning bias is appropriately varied by the cleaning bias control section based on the detected result. For example, when the operating environment varies to a high temperature condition or to a high humidity condition, the electrical resistance of the contact transfer body decreases and the discharge current from the contact transfer body increases, which causes to make the discharge current by the transfer cleaning bias become excessively large. However, according to the image forming device described above, the applying time of the transfer cleaning bias is shortened by the cleaning bias control section, and thus the continuation of the conventional overdischarged condition is avoided. Therefore, even when the electrical resistance of the contact transfer body varies according to the variation of the operating environment, the image can be formed with a high degree of quality and the shortening of the service life of the image carrier such as the photosensitive drum can be prevented. Consequently, the reliability of the image forming device is improved.

In accordance with an embodiment of the present invention, the transfer bias application means is constituted to optimize the voltage of the transfer bias based on the electrical resistance of the contact transfer body and the transfer body resistance detecting section of the transfer body cleaning means is used as a part of the transfer bias application means.

According to the image forming device having such a constitution, the transfer body cleaning means is constituted by utilizing the transfer body resistance detecting section which is formed in the transfer bias application means for optimizing the voltage of transfer bias. Therefore, the cost of the device is reduced by using the transfer body resistance detecting section as two functions and thus the above-mentioned effects can be realized at a low cost.

In accordance with an embodiment of the present invention, the cleaning bias control section varies the applying time of the transfer cleaning bias based on a size judgment signal for the recording paper in addition to based on the detection output signal from the transfer body resistance detecting section.

According to the image forming device having such a constitution, the applying time of the transfer cleaning bias is changed according to the large/small relation of the size of the recording paper to be used in addition to the variation of the above-mentioned operating environment. For example, when the size of the recording paper to be used is larger than a predetermined reference size, it is judged that the soiling of the transfer roller by toner is reduced. In this case, the applying time of the transfer cleaning bias is shortened and thus the continuation of the overdischarged condition is avoided and the above-mentioned effects can be surely obtained.

In accordance with an embodiment of the present invention, the contact transfer body is formed by using a material of ionic conductivity. For example, when a transfer roller of an ion conductive type is used whose electrical resistance is easily affected by its operating environment, the above-mentioned effects can be particularly satisfactorily obtained.

In accordance with an embodiment of the present invention, the image forming device includes a reference value for the detection output signal from the transfer body resistance detecting section which is set in the cleaning bias control section so as to correspond to humidity environment. The applying time of the transfer cleaning bias is changed according to a large/small comparison with the reference value.

According to the image forming device having such a constitution, the electrical resistance value of the detected contact transfer body is classified into a larger level or a smaller level and the applying time of the transfer cleaning bias is controlled so as to correspond to the classification of the large/small levels. Therefore, a simple and reliable control operation can be attained and the above-mentioned effects can be surely obtained at a low cost.

In accordance with an embodiment of the present invention, the cleaning bias control section is constituted such that an applying time of an electrifying bias is changed at the time of the cleaning operation of a primary electrifying bias control means for electrifying a surface of the image carrier.

According to the image forming device having such a constitution, the applying time of the primary electrifying bias in the cleaning operation is changed according to the variation of the operating environment. For example, when the resistance of the primary electrifying roller decreases due to a high temperature or a high humidity environment and the discharge current from the primary electrifying roller increases, it is judged that the discharge current of the primary electrifying bias becomes large. According to the embodiment of the present invention, the applying time of the primary electrifying bias is shortened to avoid the continuation of the overdischarged condition as the conventional example and the above-mentioned effects can be further improved.

Other features and advantages of the invention will be apparent from the following detailed description, taken in conjunction with the accompanying drawings that illustrate, by way of example, various features of embodiments of the invention.

DETAILED DESCRIPTION OF THE PREFERRED EMBODIMENTS

An embodiment of the present invention will be described in detail below with reference to the accompanying drawings. A schematic description of a laser printer will be made first as an example of the entire constitution of an image forming device.

Figure 1:
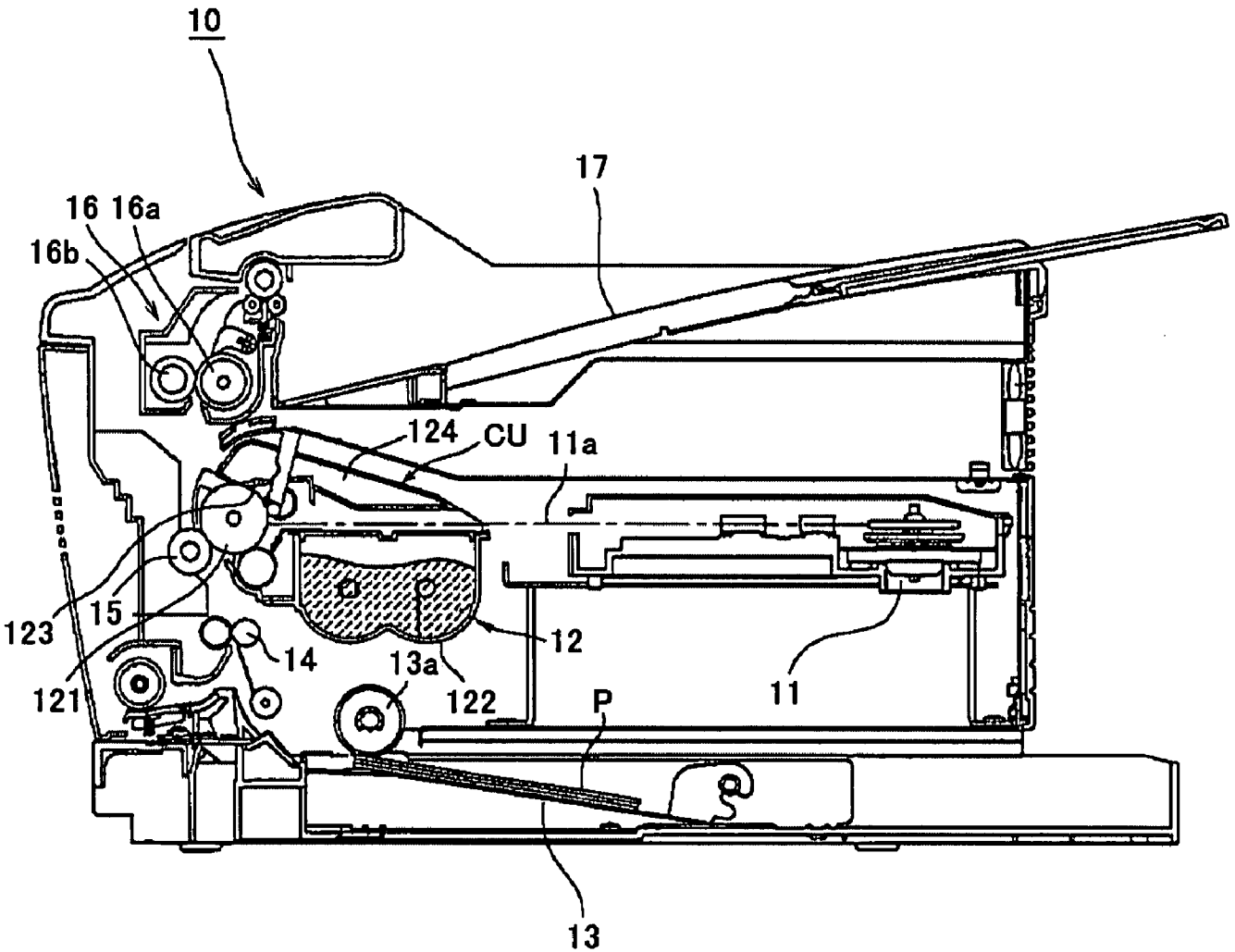
FIG. 1 is an explanatory longitudinal cross sectional view which shows the entire structure of a laser printer as an example of an image forming device to which the present invention is applied.

In a laser printer 10 shown in FIG. 1, image information sent from an external computer is focused as optically-modulated information 11*a* in a spot shape on a photosensitive drum 121 as an image carrier by a laser emission writing part 11, which is installed in a process cartridge 12, by using a video controller not shown in the drawing. The optical spot is reciprocally scanned in the axial direction (main scanning direction) of the photosensitive drum 121 and an electrostatic latent image is formed on the photosensitive drum 121 so as to correspond to the image to be formed. A developer (toner) is supplied from a developing unit 122 integrally provided within the process cartridge 12 to an electrostatic latent image on the photosensitive drum 121 and an unfixed toner image is formed.

Recording papers P stored in a paper feeding part such as a paper feed cassette 13 are disposed in the lower part of the image forming device. A recording paper P in the paper feed cassette 13 is extracted by a paper feed roller 13*a* and sent to a transfer area where the recording paper P faces the photosensitive drum 121 while appropriately being timed by the resist roller 14.

A transfer roller 15 as a contact transfer body is arranged in the transfer area of the photosensitive drum 121 so as to contact on the surface of the photosensitive drum 121. A transfer bias as described below is applied to the transfer roller 15 and the unfixed toner image on the photosensitive drum 121 is electrostatically transferred on the recording paper P by the transfer bias. In addition, the residual toner on the photosensitive drum 121 after transcription is scraped away and separated by a sliding contact force of a cleaning blade 123 which is disposed to pressure contact on the surface of the photosensitive drum 121. The waste toner scraped by the cleaning blade 123 is stored in a waste toner storing part 124 which is arranged in a cleaning unit CU provided with the cleaning blade 123.

The recording paper P on which the unfixed toner is carried by the above-mentioned transfer operation is carried to a fixing unit 16 which is arranged to be positioned in close proximity and above the process cartridge 12. The fixing device 16 includes a fixing roller 16*a* and a press roller 16*b* as a heater. The unfixed toner on the recording paper P is heated and melted by heating and fixing operation of the fixing roller 16*a* and the press roller 16*b* and thereby a toner image is fixed on the recording paper P. The recording paper P on which the toner image is fixed by the above-mentioned heating and fixing operation is ejected on a paper ejection tray 17 arranged at the upper part of the image forming device.

Figure 2:
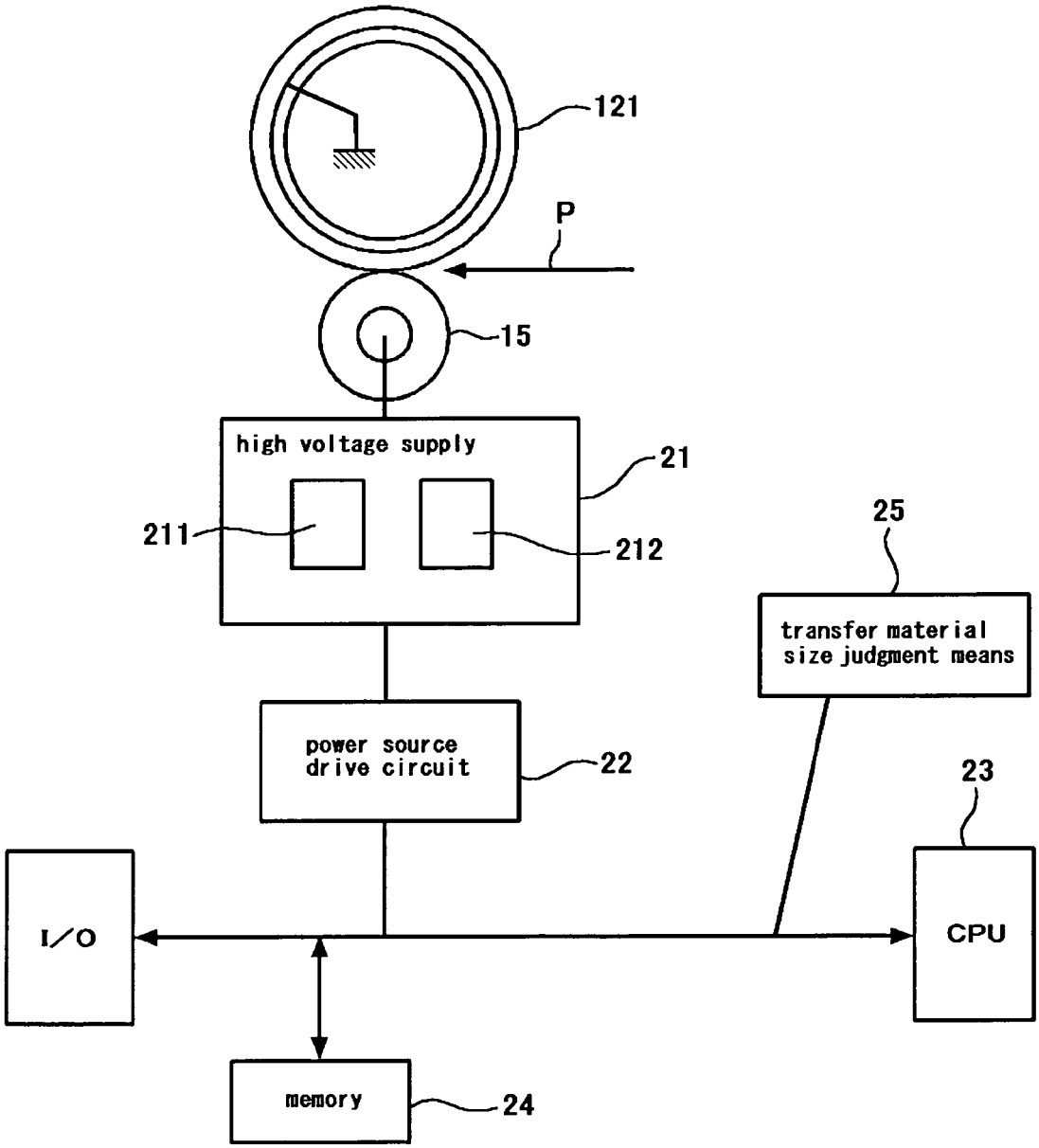
FIG. 2 is a block diagram which shows the constitution of a transfer bias application means and a transfer body cleaning means used in the laser printer shown in FIG. 1 in accordance with an embodiment of the present invention.

In the transfer area of the photosensitive drum 121, as shown in FIG. 2, a transfer roller 15 as the contact transfer body is arranged so as to contact with the photosensitive drum 121 as the above-mentioned image carrier. A high voltage power supply unit 21 is electrically connected to the transfer roller 15. A power source 211 which is a transfer bias application means is provided in the high voltage power supply unit 21. The power source 211 is activate by the power source drive circuit 22 such that the transfer bias for transferring the toner image on the photosensitive drum 121 to the recording paper P is applied to the transfer roller 15 with the inverted polarity to that of the toner.

The transfer roller 15 used in the embodiment of the present invention is constituted of a transfer roller of an ion conductive type, which includes a conductive core bar and an elastic rubber layer having ionic conductivity provided on the outer peripheral face of the conductive core bar. The transfer roller 15 of the ion conductive type has a little dispersion based on material but its electrical resistance is easily affected by the operating environment, particularly by the ambient humidity, which may cause to make the transfer bias unstable. Therefore, in the embodiment of the present invention, a control means for optimizing the voltage of the transfer bias (hereinafter, referred to as ATVC control means) is used, which is, for example, disclosed in Japanese Patent Laid-Open No. Hei 2-123385.

The ATVC control means, whose detailed structure is not described, is constituted so as to appropriately control the power source drive circuit 22 by the operation of a CPU 23 through a memory 24. For example, in a pre-rotation before an image forming process, a desired constant current is applied to the photosensitive drum 121 through the transfer roller 15. A voltage value generated at the time is measured by a transfer body resistance detecting section not shown in the drawing to detect the value of an electrical resistance of the transfer roller 15 at the present time. The voltage of the transfer bias is optimized based on the detection signal outputted by the transfer body resistance detecting section, that is, the measured value of the electrical resistance of the transfer roller 15. The transfer bias with the optimized voltage is applied to the transfer roller 15 at the time of transcription in the image forming process.

A power source 212 is provided in the above-mentioned high voltage power supply device 21 as a transfer cleaning bias application means which outputs a transfer cleaning bias of the same polarity with the toner. For example, in the post-rotation after the image forming process, the above-mentioned transfer cleaning bias is applied to the transfer roller 15 from the transfer body cleaning means including the power source 212 over an appropriate time period. As a result, the cleaning operation of the toner attached and remained on the transfer roller 15 is performed by means of the electrostatic operation of the transfer cleaning bias.

In the transfer body cleaning means in the embodiment of the present invention, a cleaning bias control section, which varies the applied time of the above-mentioned transfer cleaning bias, is constituted so as to include the CPU 23. The cleaning bias control section (CPU 23) is constituted so as to be also used as the transfer body resistance detecting section of the above-mentioned ATVC control means. The CPU 23 is appropriately operated through the memory 24 based on the detected output signal relating to the value of the electrical resistance of the transfer roller 15 at the present time which is detected by the transfer body resistance detecting section. And the power source drive circuit 22 of the above-mentioned power source 212 is controlled as follows.

Figure 3:
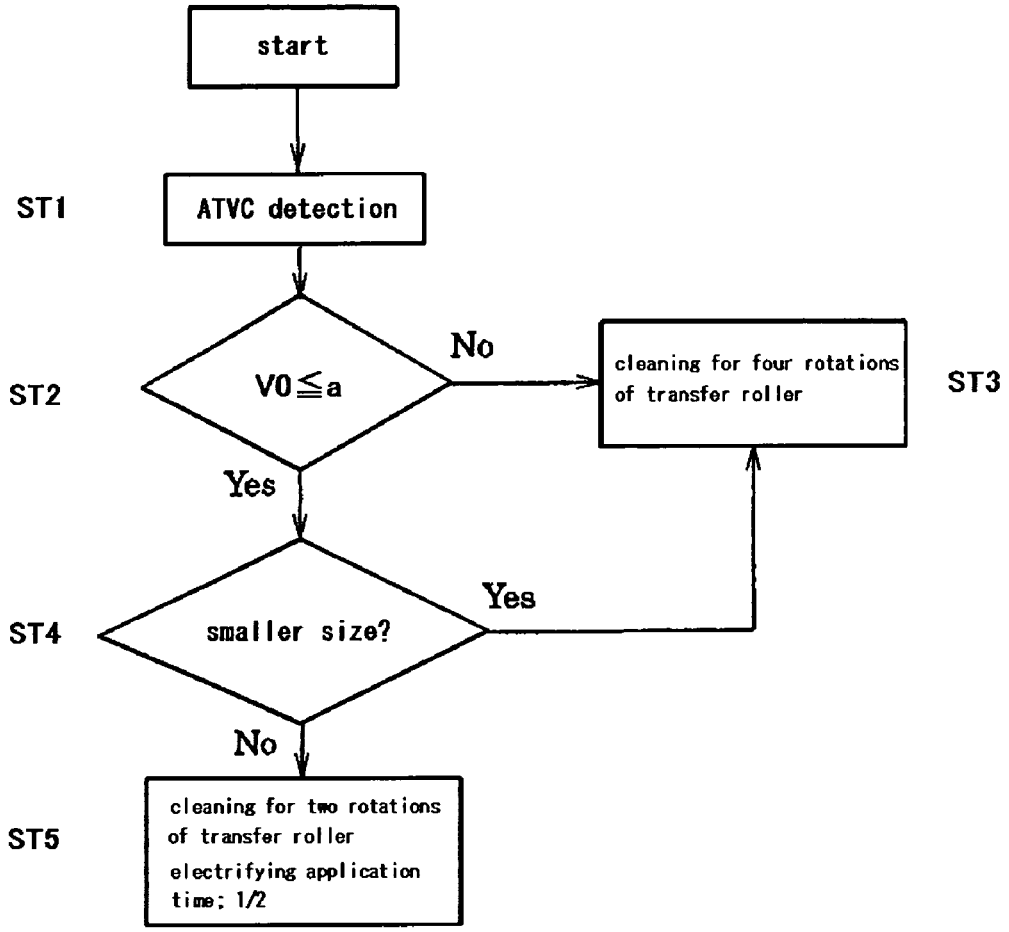
FIG. 3 is a flow chart which shows a procedure of the cleaning operation in the transfer body cleaning means shown in FIG. 2.

In other words, the cleaning bias control section is provided with a function which appropriately controls the on-and-off timing of the transfer cleaning bias. As shown in FIG. 3, firstly in step 1, the value of the electrical resistance of the transfer roller 15 at the present time is detected by using the transfer body resistance detecting section of the above-mentioned ATVC control means (ATVC detection). The value of the voltage corresponding to the detected value of the electrical resistance of the transfer roller 15 is set to be "V0".

Figure 4:
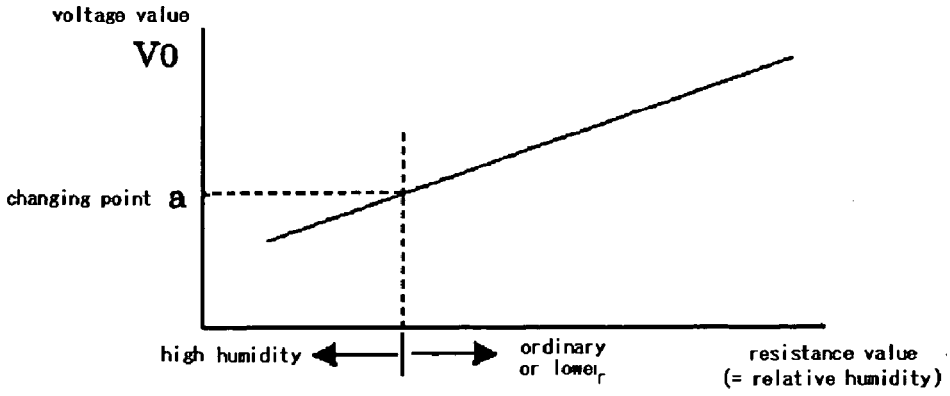
FIG. 4 is a graph which shows the meaning of a threshold value in the operation of the transfer body cleaning means shown in FIG. 2.
Figure 5:
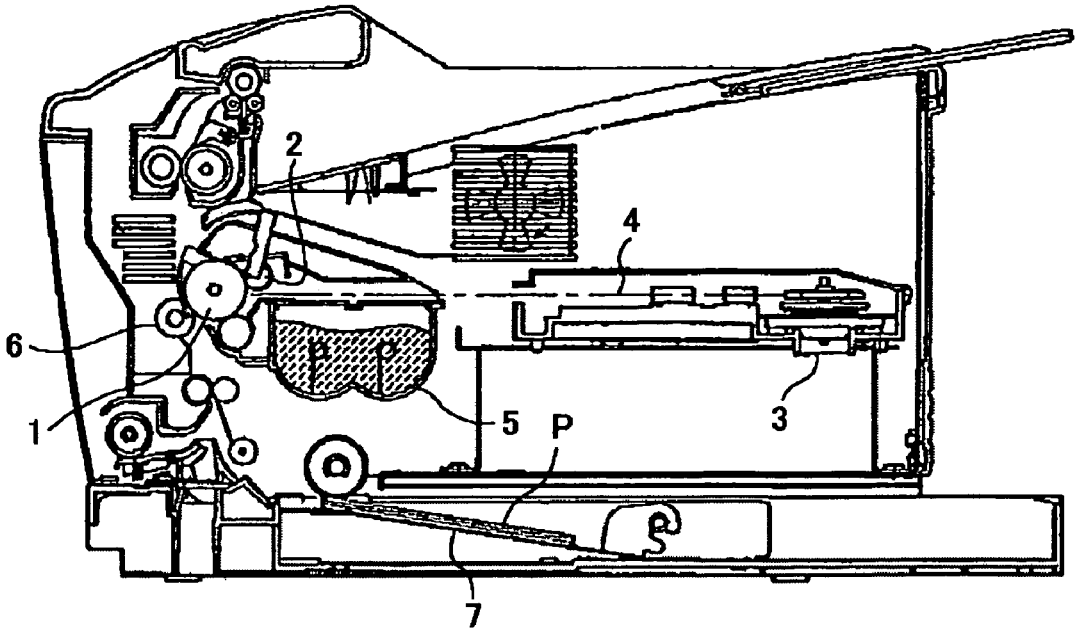
FIG. 5 is an explanatory longitudinal cross sectional view which shows the structure of a laser printer as an example of a conventional image forming device.

Next, in step 2, the above-mentioned voltage value "V0" is compared with the threshold value "a" determined from the relationship between the value of the resistance, i.e., the relative humidity (horizontal axis) and the voltage value "V0" (vertical axis), which is obtained by the experiments in advance as shown in FIG. 4. As a result of the comparison, when the voltage value "V0" is equal to the threshold value "a" or lower (Yes), it is determined that the environment where the image forming device is placed is in a high temperature/high humidity condition. On the contrary, when the voltage value "V0" is higher than the threshold value "a" (No), it is determined that the main body of the image forming apparatus is placed not in a high temperature/high humidity environment but in a normal environment, and step 3 is executed. In step 3, an ordinary transfer cleaning operation is performed, for example, over the time period of four rotations of the transfer roller 15.

Further, the above-mentioned cleaning bias control section (CPU 23) is constituted so as to take a size judgment signal outputted from a transfer material size judgment means 25 as well as a detection output signal from the transfer body resistance detecting section in the ATVC control means. The above-mentioned applying time of the transfer cleaning bias is changed based on the size judgment signal of a recording paper P which is used at present. This is because that the soiling degree on the surface of the transfer roller 15 becomes higher in the case that a small sized recording paper is passed through than in the case that a large sized recording paper is passed through. In step 2 shown in FIG. 3, when the voltage value "V0" detected in the transfer body resistance detecting section in the ATVC control means is equal to the threshold value "a" or lower (Yes), in the next step 4, it is determined whether the size of the recording paper P passing through at the time is smaller than the standard size or not.

Then, when the size judgment signal outputted from the transfer material size judgment means 25 indicates the small size (Yes), the operation in step 3 is performed, that is, an ordinary transfer cleaning operation is performed, for example, over the time period of four rotations of the transfer roller 15. On the other hand, when the size judgment signal outputted from the transfer material size judgment means 25 indicates the large size (No), the operation in step 5 is performed. In step 5, a transfer cleaning operation with the cleaning operation time is reduced to roughly half time period of the ordinary transfer cleaning operation. For example, the transfer cleaning operation is performed over the time period of two rotations of the transfer roller 15.

The reference value for size judgment of the recording paper P in the transfer material size judgment means 25 may be determined in such a manner that, for example, in an A4 printer, the recording paper P of the size "A4" is set to be a large size and other sizes are set to be a small size. Alternatively, only a postcard and an envelope may be set to be a small size.

As described above, in the embodiment of the present invention, when the value of the electrical resistance of the transfer roller 15 varies with the variation of the operating environment, the variation of the value of the electrical resistance is detected by the transfer body resistance detecting section. On the basis of the detection result, the applying time of the transfer cleaning bias is appropriately changed by the cleaning bias control section. For example, when the operating environment varies to a high temperature condition or to a high humidity condition, the value of the electrical resistance of the transfer roller 15 decreases to cause to increase the value of the discharge current from the transfer roller 15. Therefore, the discharge current by the transfer cleaning bias may become excessive. However, in the embodiment of the present invention, the applying time of the transfer cleaning bias is shortened by means of the cleaning bias control section and thus the continuation of the conventional overdischarged condition is avoided.

Also, in the embodiment of the present invention, the transfer bias application means is constituted so as to serve as the ATVC control means for optimizing the voltage of the transfer bias based on the value of the electrical resistance of the transfer roller 15. Further, the transfer body resistance detecting section of the transfer body cleaning means is constituted so as to be also used as a part of the transfer bias application means. As described above, the transfer body cleaning means is constituted so as to utilize the transfer body resistance detecting section provided in the transfer bias application means which optimizes the voltage of the transfer bias. Therefore, the cost of the image forming device is reduced.

Moreover, in the embodiment of the present invention, the cleaning bias control section is constituted so as to change the applying time of the transfer cleaning bias based on the size judgment signal of the recording paper P as well as the detection output signal from the transfer body resistance detecting section. Therefore, the applying time of the transfer cleaning bias is changed based on the large/small relation of the size of the recording paper P to be used as well as based on the variation of the operating environment. Consequently, the continuation of the overdischarged condition is avoided assuredly.

Furthermore, in the embodiment of the present invention, the transfer roller 15 is formed by a material having ion conductivity in which the electrical resistance value is easily affected by the operating environment and thus a particularly satisfactory operation can be obtained.

In addition, in the embodiment of the present invention, the reference value of the detection output signal from the transfer body resistance detecting section is set so as to correspond to the humidity environment in the cleaning bias control section. The applying time of the transfer cleaning bias is changed on the basis of the compared result whether the detection output signal is larger or smaller to the reference value. In other words, the value of the electrical resistance of the detected contact transfer body is classified into two high/low levels, and thus the applying time of the transfer cleaning bias is set and controlled to be one of two time periods determined according to the classification of two high/low levels. Therefore, simple and reliable control operation can be obtained.

The present invention has been described in detail using the embodiments, but the present invention is not limited to the embodiments described above and many modifications can be made without departing from the present invention.

For example, in the embodiment described above, a part of the ATVC control means is constituted to be also used as the transfer body resistance detecting section. However, various types of environment sensing means such as a humidity sensor can be adopted.

Further, in the embodiment described above, the transfer roller as the contact transfer body is formed from material of ion conductivity whose electrical resistance is easily affected by the operating environment. However, the present invention is not limited to the embodiment described above, other materials can be similarly adopted to the contact transfer body when they are affected by the operating environment.

In addition, in the embodiment described above, the cleaning bias control section may be constituted so as to vary the applying time of the electrifying bias at the time of the cleaning operation of the primary electrifying bias control means which electrifies the surface of the photosensitive drum. According to the constitution described above, the applying time of the primary electrifying bias in the cleaning operation varies with the variation of the operating environment. For example, when the value of the resistance of the primary electrifying roller decreases due to a high temperature or a high humidity environment and the discharge current from the primary electrifying roller increases, it is judged that the discharge current of the primary electrifying bias becomes large. According to the embodiment of the present invention, the applying time of the primary electrifying bias is shortened to avoid the continuation of the overdischarged condition as the conventional example.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An image forming device comprising:

an image carrier which holds a toner image formed by developing;

a contact transfer body which is arranged so as to contact with the image carrier;

a transfer bias application device which applies a transfer bias to the contact transfer body for transferring the toner image on the image carrier to a recording element;

a transfer body cleaning device which applies a transfer cleaning bias whose polarity is inverted from that of the transfer bias to the contact transfer body for performing a cleaning operation for a toner which is attached or remained on the contact transfer body, the transfer body cleaning device comprising:

a transfer body resistance detecting section which detects and outputs a value of an electrical resistance of the contact transfer body; and a cleaning bias control section which changes an applying time of the transfer cleaning bias based on a detection output signal from the transfer body resistance detecting section, wherein the cleaning bias control section varies the applying time of the transfer cleaning bias based on a size judgment signal for the recording element in addition to based on the detection output signal from the transfer body resistance detecting section.

2. The image forming device according to claim 1, wherein the transfer bias application device is constituted to optimize a voltage of the transfer bias based on the value of the electrical resistance of the contact transfer body and the transfer body resistance detecting section of the transfer body cleaning device is used as a part of the transfer bias application device.

3. The image forming device according to claim 1, wherein the contact transfer body is formed by using material of ionic conductivity.

4. The image forming device according to claim 1, further comprising a reference value which is set in the cleaning bias control section for the detection output signal from the transfer body resistance detecting section so as to correspond to humidity environment, wherein an applying time of the transfer cleaning bias is changed according to a large/small comparison with the reference value.

5. The image forming device according to claim 1, wherein the cleaning bias control section is constituted such that an applying time of an electrifying bias is changed at the time of a cleaning operation of a primary electrifying bias control device electrifying a surface of the image carrier.

6. An image forming device comprising:

an image carrier which holds a toner image formed by developing;

a contact transfer body which is arranged so as to contact with the image carrier;

a transfer bias application device which applies a transfer bias to the contact transfer body for transferring the toner image on the image carrier to a recording element;

a transfer body cleaning device which applies a transfer cleaning bias whose polarity is inverted from that of the transfer bias to the contact transfer body for performing a cleaning operation for a toner which is attached or remained on the contact transfer body, the transfer body cleaning device comprising:

a transfer body resistance detecting section which detects and outputs a value of an electrical resistance of the contact transfer body changing according to humidity and temperature environment; and a cleaning bias control section which changes an applying time of the transfer cleaning bias based on a detection output signal from the transfer body resistance detecting section.

7. The image forming device according to claim 6, wherein the transfer bias application device is constituted to optimize a voltage of the transfer bias based on the value of the electrical resistance of the contact transfer body and the transfer body resistance detecting section of the transfer body cleaning device is used as a part of the transfer bias application device.

8. The image forming device according to claim 6, wherein the contact transfer body is formed by using material of ionic conductivity.

9. The image forming device according to claim 6, wherein the cleaning bias control section is constituted such that an applying time of an electrifying bias is changed at the time of a cleaning operation of a primary electrifying bias control device for electrifying a surface of the image carrier.

10. The image forming device according to claim 6, wherein a reference value which is set in the cleaning bias control section for the detection output signal from the transfer body resistance detecting section so as to correspond to humidity environment, wherein an applying time of the transfer cleaning bias is changed according to a large/small comparison with the reference value.

11. An image forming device comprising:

an image carrier;

a contact transfer body which is arranged so as to contact with the image carrier;

a transfer bias application device configured to apply a transfer bias to the contact transfer body transferring a toner image on the image carrier to a recording element;

a transfer body cleaning device configured to apply a transfer cleaning bias to remove toner which remains on the contact transfer body, the transfer body cleaning device varies the applying time of the transfer cleaning bias based on a size judgment signal for the recording element and a condition of an environment surrounding the image forming device.

* * * * *